United States Patent [19]

Sano

[11] Patent Number: 4,475,359

[45] Date of Patent: Oct. 9, 1984

[54] AIR CONDITIONING APPARATUS

[75] Inventor: Hideki Sano, Fujinomiya, Japan

[73] Assignee: Tokyo Shibaura Denki Kabushiki Kaisha, Kawasaki, Japan

[21] Appl. No.: 435,358

[22] Filed: Oct. 20, 1982

[30] Foreign Application Priority Data

| | | | |
|---|---|---|---|
| Oct. 27, 1981 | [JP] | Japan | 56-159098[U] |
| Oct. 30, 1981 | [JP] | Japan | 56-161216[U] |
| Oct. 31, 1981 | [JP] | Japan | 56-163043[U] |
| Oct. 31, 1981 | [JP] | Japan | 56-163044[U] |

[51] Int. Cl.[3] ..... F25D 23/12

[52] U.S. Cl. ..... 62/272; 62/150

[58] Field of Search ..... 62/272, 271, 270, 273, 62/274, 150, 92

[56] References Cited

FOREIGN PATENT DOCUMENTS

| | | |
|---|---|---|
| 3644 | of 1976 | Japan . |
| 37179 | 8/1977 | Japan . |
| 36959 | 3/1979 | Japan . |
| 56462 | 4/1979 | Japan . |
| 171266 | 12/1979 | Japan . |
| 49475 | 11/1980 | Japan . |

*Primary Examiner*—Albert J. Makay
*Assistant Examiner*—Henry Bennett
*Attorney, Agent, or Firm*—Stevens, Davis, Miller & Mosher

[57] ABSTRACT

Disclosed is an air conditioning device comprising a housing, a refrigerator, and a condensate disposing device comprising an electric switch for controlling the operation of the refrigerator, a condensate tank for receiving condensate delivered from the refrigerator, a float swingably secured to the condensate tank for controlling the operation of the switch according to the quantity of a condensate stored in the tank, and a tank holding box secured to the housing, with the electric switch being secured to an extended part of one side wall of the tank holding box for assuring a constant operation of the electric switch. The bottom walls of the condensate tank and the tank holding box are both tapered downwardly toward a condensate tank removed side for facilitating the insertion of the condensate tank into the tank holding box.

8 Claims, 15 Drawing Figures

AIR CONDITIONING APPARATUS

BACKGROUND OF THE INVENTION

This invention relates generally to an air conditioning apparatus, and more particularly to a condensate disposing device provided in the air conditioning apparatus.

FIG. 1 illustrates a typical example of a conventional air conditioning apparatus generally designated by a reference character a and comprising a housing b, a refrigerator inclusive of an evaporator c provided in an upper part of the housing b, a condensate receiving tray e having a water discharge port d provided below the evaporator c, and a condensate disposing device including a condensate tank f provided below the tray e for storing condensate delivered from evaporator c through the port d of the water receiving tray e. The tank f is removably mounted on a seat h mounted on the bottom plate g of the housing b. The condensate disposing device further comprises a float k swingable within the tank f, and a switch j having a stationary portion secured to a partition wall in the housing b. One end of the float k is secured to the tank f to be swingable around a pivot pin i, while the other end of the float k is brought into engagement with an operating member of the switch j. When the water level in the tank f goes up in excess of a predetermined value, the float swings around the pivot pin i to operate the switch j so as to interrupt the operation of the air conditioning apparatus.

In the above described construction of the conventional air conditioning apparatus, however, the position of the seat h for the tank f and the position of the switch j have been determined independently when these members are assembled, thus tending to introduce a harmful error in the engagement between the end of the float k and the switch j.

The conventional float k has been constructed in the form of, for instance, a cylindrical configuration opening upwardly because of the simplicity of manufacturing so that such a construction tends to collect dust or water delivered from the evaporator c into the upwardly opened space of the float k, and reducing the buoyancy.

Furthermore, the condensate tank f of the conventional design has been held in its position under a gravitational force, so that the tank f is easily displaced by vibration or shock. Any attempt for ensuring tighter engagement between the bottom of the tank f and the tank seat h would entail a disadvantage of rendering the removal of the tank f out of the seat h for disposing condensate to be more difficult.

In addition, the tank f of the conventional construction has been provided with a handle at the upper front edge thereof. However, when the tank f is held by the handle and removed out of the tank seat h, the tank f tends to tilt to spill the condensate out of the tank f. Any attempt to narrow the tank opening for eliminating such difficulty has made to disposal of the condensate to difficult.

SUMMARY OF THE INVENTION

A basic object of the present invention is to provide an air conditioning apparatus including an improved condensate disposing device which can obviate the above described difficulties of the conventional construction.

Another object of the invention is to provide an air conditioning apparatus including an improved condensate disposing device wherein relative positions of the float and the switch are always held constant, and a steady and reliable operation of the device can be thereby obtained.

Still another object of the invention is to provide an air conditioning apparatus including a condensate disposing device, wherein the component members such as the float and the condensate tank are further improved for rendering the operation of the device to be reliable and efficient.

According to the present invention, there is provided an air conditioning apparatus comprising a housing, a refrigerator inclusive of an evaporator encased in the housing, and a condensate disposing device comprising an electric switch for on-off controlling the operation of the refrigerator, a condensate tank for receiving condensate delivered from the evaporator, and a float swingably provided in the condensate tank for initiating the on-off control operation of the electric switch according to the quantity of condensate stored in the condensate tank, the condensate disposing device further comprising a tank holding box constructed integrally with the housing for detachably receiving the condensate tank, and means for detachably holding the condensate tank at a predetermined position in the tank holding box, the improvement wherein bottom walls of the condensate tank and the tank holding box are both tapered downwardly toward a front side and the electric switch is fixedly mounted on a holding plate formed as an extension of a side wall of the tank holding box.

In another embodiment of the present invention, the float is formed into a configuration opening downwardly toward the condensate in the tank so that any possibility of collecting dust and the like in the float is thereby eliminated.

In still another embodiment of the invention, the condensate tank and the tank holding box have bottom plates tapered upwardly and rearwardly away from an opening of the tank holding box, through which the condensate tank is received, and a resilient plate is provided at the top of the tank holding box for urging the condensate tank downwardly.

In a further embodiment of the invention, the condensate tank is provided with a rise-up portion rising inwardly upwardly from one side wall of the same tank, so that a finger insertable recess is formed within the rise-up portion.

The invention will now be described in detail with reference to the accompanying drawings.

DETAILED DESCRIPTION OF PREFERRED EMBODIMENTS

Figure 1:
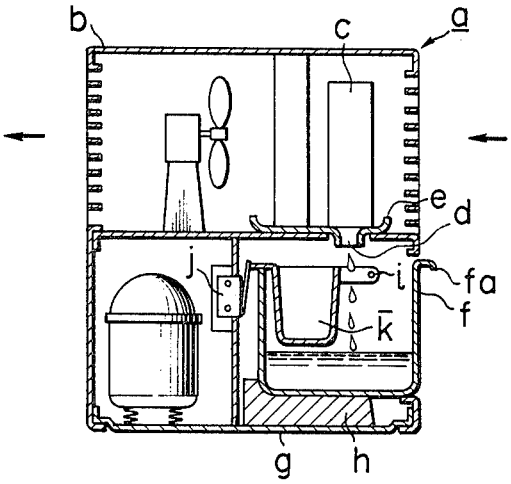
FIG. 1 PRIOR ART
FIG. 1 is a vertical cross-sectional view of a conventional air conditioning apparatus including a condensate disposing device.
Figure 2:
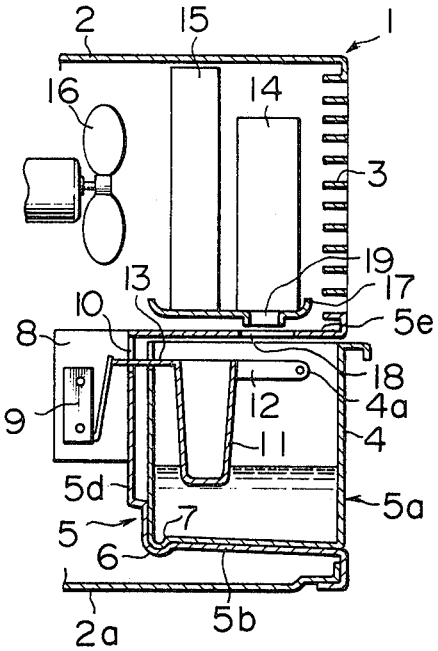
FIG. 2 is a vertical cross-sectional view showing the essential portions of a preferred embodiment of the present invention.
Figure 3:
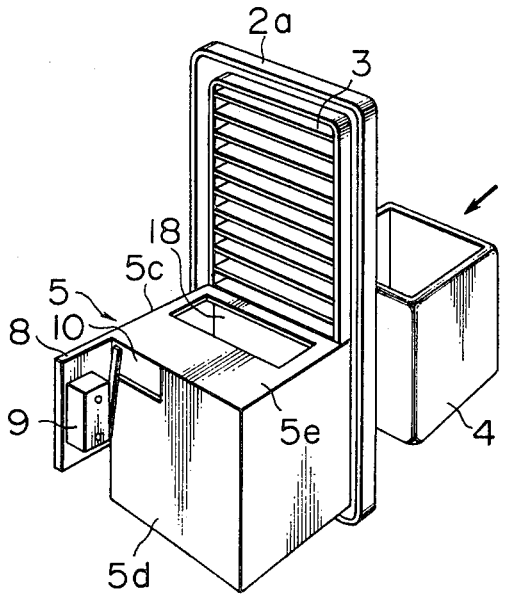
FIG. 3 is a perspective view showing a portion of the embodiment shown in FIG. 2.

Referring now to FIGS. 2 and 3, there is illustrated an air conditioning apparatus including a condensate disposing device constituting a preferred embodiment of the present invention.

A housing 2 provided for encasing the air conditioning apparatus 1 and hence the condensate disposing device has a portion formed into a suction side panel 2*a*. At an upper portion of the housing 2 is provided an air entrance port 3 which in combination with an air exhaust port (not shown) provides an air passage of the apparatus 1. A tank holding box 5 having an opening 5*a* through which a tank 4 is brought into or removed out of the box 5 is provided in a lower portion of the suction side panel 2*a* to be integral with the housing 2. The tank 4 opens upwardly to receive a condensate delivered from the air conditioning apparatus 1. The tank holding box 5 generally has an inner dimension slightly larger than the outer dimension of the tank 4. The tank holding box 5 and the tank 4 have bottom walls slightly tapered downwardly toward the front side. Along one edge of a bottom wall 5*b* remote from the opening 5*a* of the tank holding box 5 is provided a groove 6 which is engageable with a length of projection 7 projecting downwardly from the bottom wall of the tank 4 thereby to prevent the movement of the tank 4 relative to the tank holding box 5. A switch 9 is mounted on a holding plate 8 (defined by mounting holes not shown) provided in a rearwardly extended portion of one side wall 5*c* of the tank holding box 5. A window 10 formed through a rear wall 5*d* of the box 5 provides an access from the switch position to the interior of the tank holding box 5.

Internally of the tank 4 is provided a float 11 having, on one side thereof, a lever 12 which is secured to the tank 4 to be swingable around a pivot pin 4*a*, and on the other side thereof is provided an operating arm 13 extending rearwardly through the window 10 toward the electric switch 9, so that a rear end of the arm 13 is engageable with an operating member of the switch 9. In ordinary cases, the switch 9 and the arm 13 are so arranged that when the arm 13 engages with the operating member of the switch 9, the switch 9 closes an electric circuit to operate the refrigerator of the air conditioning apparatus, while when the arm 13 disengages from the operating member of the switch 9, the switch 9 opens the electric circuit to interrupt the operation of the refrigerator.

As shown in FIG. 2, an evaporator 14, a condenser 15 and a fan 16 constituting in combination a refrigerator circuit are provided above the tank holding box 5. The evaporator 14 and the condenser 15 are mounted on a condensate receiving tray 17 provided above the tank holding box 5. The tray 17 has a water discharge port 19 provided therethrough in alignment with another hole 18 provided through a cover plate 5*e* of the tank holding box 5. The condensed water separated by the evaporator 14 from the air passing through the air passage is firstly received in the condensate receiving tray 17, and then discharged through the holes 19 and 18 into the condensate tank 4 held within the tank holding box 5.

The condensate disposing device of this invention operates as follows.

When the operating arm 13 extending rearwardly from the float 11 through the window 10 operates the switch 9, the dehumidifying operation of the refrigerator is initiated to condense water around the evaporator. The condensate is received in the tray 17, and passed through the holes 19 and 18 into the tank 4. When the quantity of the condensate in the tank 4 increases in excess of a predetermined amount, the float 11 in the tank 4 goes up to operate the switch 9 so as to interrupt the operation of the refrigerator.

According to the present invention, the holding plate 8 provided with mounting holes (not shown) is constructed integrally with a side plate of the tank holding box 5 which defines the position of the tank 4 as described above, so that the position of the switch 9 mounted on the holding plate 8 and the position of the tank 4 held in the tank holding box 5 are held in a predetermined relationship, and the introduction of a harmful error in the engagement of the arm 13 and the switch 9 can be thereby substantially eliminated.

When the condensate water in the tank 4 exceeds a predetermined level, the tank 4 is pulled out of the tank holding box 5, and the water therein is disposed as desired. When the tank 4 is returned into the tank holding box 5 so that the projection 7 of the tank 4 fits into the groove 6 of the box 5, the arm 13 of the float 11 automatically engages with the operating member of the switch 9 thereby to resume the dehumidifying operation. In the above described case, since the inner dimension of the tank holding box 5 is selected to be slightly larger than the outer dimension of the condensate tank 4, and furthermore since the groove 6 of the box 5 and the projection 7 of the tank 4 assure a precise positioning of these members, a constant engagement can be maintained between the arm 13 of the float 11 and the operating member of the switch 9, and a high reliability of the switch operation can be achieved.

Figure 4:
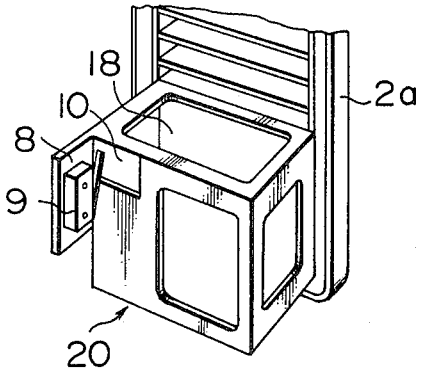
FIG. 4 is a perspective view showing a portion of a modification of the embodiment shown in FIG. 2.

FIG. 4 illustrates a modification of the embodiment shown in FIGS. 2 and 3 wherein the tank holding box 5 is formed into a frame-like structure 20 having a number of cut-away portions for economizing the material without sacrificing the advantageous feature of the present invention.

The embodiment of the present invention shown in FIGS. 2 and 3 has the following advantages.

(1) The integral construction of the tank holding box and the holding plate of the switch ensures a constant relative positioning of these members in the manufacturing stage of the apparatus, and any irregularity in the engagement between the arm 13 and the switch 9 of all products can be substantially eliminated.

(2) Since the inner dimension of the tank holding box 5 has been selected to be slightly larger than the outer dimension of the tank 4, and the projection-and-groove engagement has been provided therebetween, the above described constant engagement between the two members can be further assured.

Figure 5:
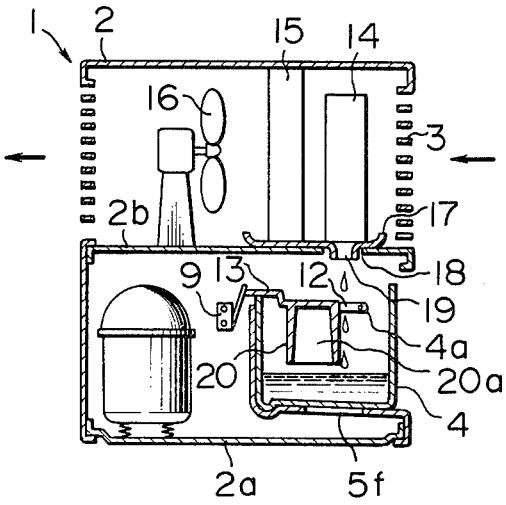
FIG. 5 is a vertical cross-sectional view showing another embodiment of the present invention.

Another embodiment of the present invention is illustrated in FIG. 5 wherein similar members as in the first embodiment shown in FIGS. 2 and 3 are designated by similar reference numerals, and further detailed description thereof is omitted for avoiding redundancy.

Briefly stated, the embodiment shown in FIG. 5 has a construction quite similar to that of the first embodiment. Like the first embodiment, the second embodiment shown in FIG. 5 has a housing 2 encasing the air conditioning apparatus. A partitioning plate 2*b* separates the housing 2 into an upper compartment encasing the evaporator 14, condenser 15, fan 16, and the tray 17 provided below the evaporator 14, and a lower compartment encasing the tank holding box 5 which removably receives the tank 4 that opens upwardly. Bottom walls of the tank 4 and the tank holding box 5 are both tapered downwardly toward the front side for facilitating the insertion of the tank 4 into the tank holding box 5. A hole 18 is provided through the partitioning plate 2*b*, while another hole 19 is provided through the tray 17 in alignment with the hole 18, so that the condensate in the tray 17 is discharged through the holes 18 and 19 into the condensate tank 4 held in the tank holding box 5. The holding plate for mounting the switch 9 is formed as an extension of a side wall of the tank holding box 5, while the tank 4 is held in its precise position by means of the projection 7 of the tank 4 and the groove 6 formed at the bottom of the tank holding box 5.

Figure 6:
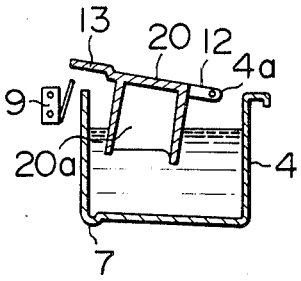
FIG. 6 is a schematic diagram showing an operating state of the embodiment shown in FIG. 5.

Instead of the float 11 opening upwardly as in the first embodiment, the second embodiment shown in FIG. 5 utilizes a float 20 having an internal space 20*a* opening downwardly. More specifically, the float 20 has a inverted U-shaped cross-sectional configuration, and is made of a light weight water-resistant material such as a synthetic resin or aluminum. When the water level in the tank 4 goes up, the float 20 is lifted upward as shown in FIG. 6 by a buoyancy caused by the air entrapped in the float 20 and the volume of a portion of the float 20 displacing water. The float 20 is connected, on one side thereof, with the lever 12 having an end pivotally secured by a pivot pin 4*a* to an internal surface of the condensate tank 4. On the other side, the float 20 is connected with the operating arm 13 extending rearwardly through the tank holding box 5 toward the switch 9 mounted on the switch mounting plate 8.

The operation of the second embodiment of FIG. 5 is quite similar to that of the first embodiment retaining all of the advantageous features thereof. Since the float 20 is formed into the inverted U-shaped cross-sectional configuration, there is no possibility of dust or any other harmful substance entering into the float 20 to reduce the buoyancy of the float, so that a constant and steady operation of the switch 9 in response to the water level in the tank 4 can be assured.

Figure 7:
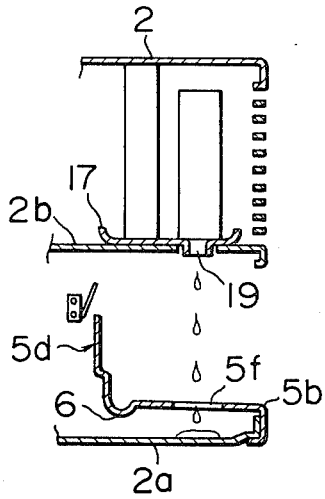
FIG. 7 is a diagram showing a state of the same embodiment with a condensate tank removed.

When the tank 4 is filled with the condensate, the tank 4 is pulled out of the tank holding box 5 for disposing the water. In this case, the condensate water dropping through the holes 19 and 18 onto the bottom plate 5*b* of the tank holding box 5 in case of vacancy of the tank 4 passes downward through a hole 5*f* provided through the bottom plate 5*b* onto the bottom 2*a* of the housing 2 as shown in FIG. 7, and is meanwhile dried out by heat created in the compressor and the like of the air conditioning apparatus.

When the tank 4 is again inserted into the tank holding box 5, the operating arm 13 of the float 20 engages the operating member of the switch 9 for operating the refrigerator of the air conditioning apparatus.

The second embodiment of the present invention has the following advantages.

(1) Since the float 20 is constructed to open downwardly toward the condensate water stored in the tank 4, there is no possibility of dust or the like falling from the evaporator or the like into the float as in the case of an upwardly opened float, and more reliable operation of the switch can be ensured.

(2) Since the float is made of a synthetic resin, aluminum or the like material, advantages such as long operational life, high water resistivity, and low production cost can be attained.

(3) Furthermore, the construction of the float is extremely simple, and easy to manufacture.

Figure 8:
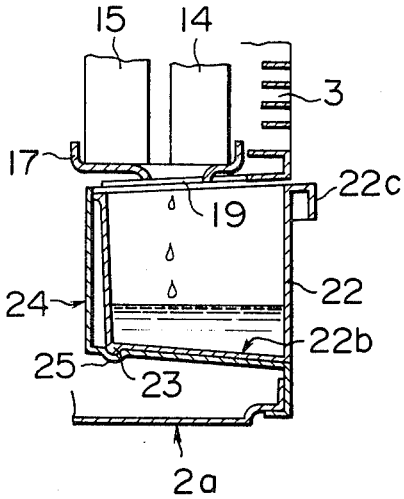
FIG. 8 is a vertical cross-sectional view showing a portion of still another embodiment of the invention.
Figure 9:
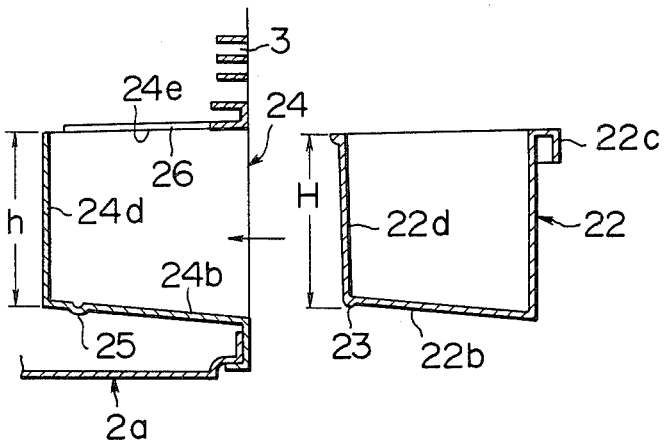
FIG. 9 is a diagram showing the operation of the embodiment shown in FIG. 8.

FIGS. 8 and 9 illustrate still another embodiment of the invention, which has a construction quite similar to that of the second embodiment shown in FIG. 5, except that the condensate tank 4 and the tank holding box 5 are both modified as follows.

According to this embodiment, there are provided a condensate tank 22 and a tank holding box 24, whose bottom plates 22*b* and 24*b* are both tapered downwardly toward the front side in all of the above described embodiments, so that the heights on the rear side of the condensate tank 22 and the tank holding box 24 are reduced to H and h, respectively. The tank 22 has a length of projection 23 projecting downwardly from the bottom wall of the tank 22 as in the case of tank 4. Likewise, the tank holding box 24 has a groove 25 formed in the bottom plate 24*b* at a position adapted to receive the projection 23 of the tank 22 when the tank 22 is inserted into the tank holding box 24 completely. The tank holding box 24 is further provided with a resilient top plate 24*e* having an opening 26 through which the condensate delivered through the hole 19 of the tray 17 is received into the condensate tank 22.

Since the height H of the condensate tank 22 is selected slightly larger than the height h of the tank holding box 24, when the condensate tank 22 is inserted into the tank holding box 24, the upper edge of the rear wall 22*d* of the tank 22 is slidably moved, while being urged by the resilient top plate 24*e* of the tank holding box 24 downwardly until the projection 23 of the tank 22 engages with the groove 25 on the bottom plate 24*b* of the tank holding box 24.

Since the condensate tank 22 in this embodiment is resiliently held between the bottom plate 24*b* and the top plate 24*e* of the tank holding box 24 in addition to the engagement between the projection 23 and the groove 25 of the two members, the tank 22 can be more firmly held in the box 24 than in the second embodiment of the invention. Since the construction of the embodiment is comparatively simple, and suitable for mass-production, it is apparent that the embodiment contributes much to the manufacturing of the disposing device.

As described hereinbefore, the condensate tank of the conventional construction has a drawback of easily spilling condensate water when the tank is taken out of the air conditioning apparatus. Furthermore, a construction of the tank having a narrowed opening as disclosed in Japanese Utility Model Laid-Open Specification No. 56462/1979 has revealed another drawback of leaving a small amount of water in the tank after the disposal.

Figure 10:
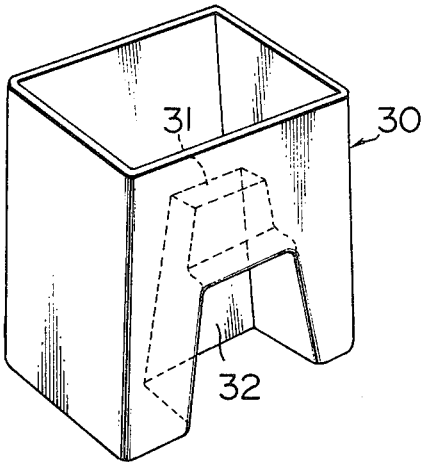
FIG. 10 is a perspective view of a condensate tank constructed in accordance with still another embodiment of the invention.
Figure 11:
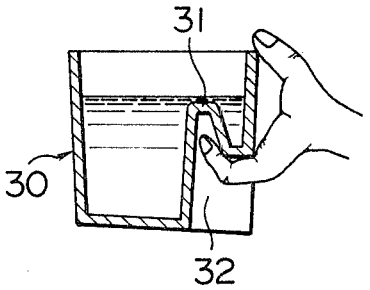
FIG. 11 is a diagram showing a handling state of the condensate tank shown in FIG. 10.

These drawbacks of the conventional constructions can be obviated by a further embodiment of the present invention shown in FIGS. 10 and 11. Although it is not shown, a condensate tank 30 of this embodiment is utilized, for instance, in the first or second embodiment of the present invention, in a manner such that the condensate tank 30 is placed below the tray 17 for receiving condensate delivered from the tray 17 into the tank 30. Although not shown in the drawing, the condensate tank 30 has a downward projection, as in the case of the tank 4, which is engageable with the groove 6 of the tank holding box 5 for assuring a predetermined positional relation between the tank 30 and the box 5. A float which is not shown for the simplicity of the drawing is provided in the condensate tank 30 to be movable around a pivotal point in accordance with the water level in the tank 30 as in the previous embodiments. The float is brought into engagement with the switch 9 mounted on a portion of the tank holding box 5 as described in detail with respect to the first and second embodiments.

Returning to FIGS. 10 and 11, the condensate tank 30 provided for obviating the above mentioned drawbacks has a hollow projection 31 rising from one side of the tank 30 so that when the tank 30 is desired to be removed out of the tank holding box 5, fingers of an operator are inserted into a space 32 formed in the projection 31 as shown in FIG. 11, so that the tank 30 is held in its upright (or not tilted) position for preventing the condensate from spilling out of the condensate tank 30.

FIGS. 12, 13, 14 and 15 illustrate various modifications of the embodiment shown in FIGS. 10 and 11.

Figure 12:
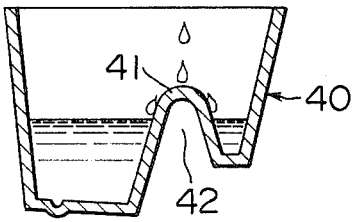
FIGS. 12 through 15 are diagrams showing various modifications of the embodiment shown in FIG. 10.

In a modification shown in FIG. 12, a condensate tank 40 of a downwardly narrowed rectangular vessel-like configuration is provided with a hollow projection 41 including a horizontally extending uppermost edge 41*a* of an arcuate cross-section, and defining internally a space 42 which permits the insertion of fingers of an operator for holding the tank 40 firmly in its upright state and preventing the condensate from spilling out of the tank 40. Since the edge 41*a* of the portion 41 is arcuated to convex upwardly, noise caused by dropping the condensate onto the edge 41*a* can be substantially reduced.

Figure 13:
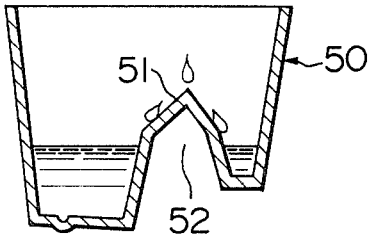

In another modification shown in FIG. 13, a condensate tank 50 of a similar configuration as that of the modification shown in FIG. 12 is provided with a projection 51 having a horizontally extending uppermost edge 51*a* of an upwardly projecting angular cross-section, and defining an internal space 52 in which fingers of an operator can be suitably inserted for firmly seizing the tank 50 in an upright position as in the previous modification. Furthermore, when the edge 51*a* of the portion 51 is brought just below the water delivering hole of a tray, the noise caused by dropping the condensate water onto the angular edge 51*a* can be substantially reduced.

Figure 14:
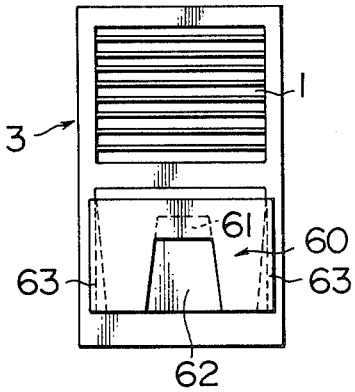
Figure 15:
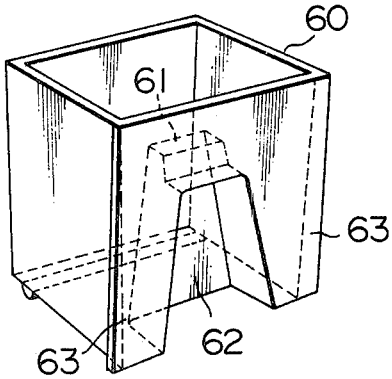

In still another modification shown in FIGS. 14 and 15, a condensate tank 60 of a downwardly narrowed rectangular vessel-like configuration having a projection 61 and an internal space 62 for receiving fingers of an operator for allowing a firm grip of the condensate tank 60, further comprises a pair of wings 63 projecting rightward and leftward as viewed in the drawing from the front wall of the tank 60, so that when the tank 60 is inserted into the tank holding box (not shown), the pair of wings 63 extend over the front parts of gaps formed between the tank 60 and the tank holding box, thereby preventing intrusion of any dust or the like into the aforementioned gaps.

Although some of the modifications of the condensate tank, tank holding box, and the float have been described above, it is apparent to those skilled in the art that further alterations and modifications can be made on these members without departing the scope of the present invention which is solely defined by the appended patent claims.

I claim:

1. In an air conditioning apparatus comprising a housing, a refrigerator inclusive of an evaporator encased in the housing, and a condensate disposing device comprising an electric switch for on-off controlling the operation of the refrigerator, a condensate tank for receiving condensate delivered from the evaporator, and a float swingably provided in the condensate tank for initiating the on-off control operation of the electric switch according to the quantity of condensate stored in the condensate tank, said condensate disposing device further comprising a tank holding box constructed integrally with said housing for detachably receiving said condensate tank, and means for detachably holding said condensate tank at a predetermined position in said tank holding box, the improvement wherein bottom walls of said condensate tank and said tank holding box are both tapered downwardly and toward a direction of drawing out said tank from said tank holding box, said electric switch is fixedly mounted on a holding plate formed as an extension of a side wall of said tank holding box, and said float of said condensate disposing device is formed into an inverted U-shaped cross-sectional configuration opening downwardly toward the condensate stored in said tank.

2. An air conditioning apparatus as set forth in claim 1 wherein said means for detachably holding said condensate tank at a predetermined position comprises a projection-and-recess engagement formed between bottom plates of said condensate tank and said tank holding box.

3. An air conditioning apparatus as set forth in claim 1 wherein said float of said condensate disposing device has an arm pivotally secured by a pivot pin to an internal surface of said condensate tank, and another arm extended outwardly through said tank holding box to a position engageable with an operating part of said electric switch.

4. An air conditioning apparatus as set forth in claim 1 wherein a height of a rear end of the condensate tank is selected to be slightly larger than a height of a rear end of the tank holding box, and a resilient plate is provided at the top of said tank holding box for urging the condensate tank downwardly when the tank is inserted into said tank holding box.

5. An air conditioning apparatus as set forth in claim 1 wherein said condensate tank in said condensate disposing device has a projection rising inwardly and upwardly from one side wall of said tank so that a finger insertable recess is formed internally of said projection.

6. An air conditioning apparatus as set forth in claim 5 wherein said projection has an upper end arcuated so as to convex upwardly.

7. An air conditioning apparatus as set forth in claim 5 wherein said projection has an upper end angled so as to project upwardly.

8. An air conditioning apparatus as set forth in claim 5 wherein said condensate tank is further provided on both sides of a front wall thereof with wings so that when said tank is inserted into said box, said wings cover both side edges of said tank holding box.

* * * * *